US008811832B2

(12) United States Patent
Itagaki et al.

(10) Patent No.: US 8,811,832 B2
(45) Date of Patent: Aug. 19, 2014

(54) IMAGE FORMING APPARATUS

(75) Inventors: Seiko Itagaki, Tokyo (JP); Natsuko Minegishi, Tokyo (JP); Hiroyuki Saito, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 426 days.

(21) Appl. No.: 13/271,595

(22) Filed: Oct. 12, 2011

(65) Prior Publication Data

US 2012/0093527 A1 Apr. 19, 2012

(30) Foreign Application Priority Data

Oct. 15, 2010 (JP) ..... 2010-232299

(51) Int. Cl.
*G03G 15/08* (2006.01)
*G03G 15/01* (2006.01)

(52) U.S. Cl.
CPC ..... *G03G 15/0834* (2013.01); *G03G 15/0126* (2013.01); *G03G 15/0839* (2013.01); *G03G 15/0824* (2013.01)
USPC ..... 399/27

(58) Field of Classification Search
CPC ..... G03G 15/0126
USPC ..... 399/27
See application file for complete search history.

(56) References Cited

U.S. PATENT DOCUMENTS

2009/0304399 A1* 12/2009 Morikuni ..... 399/27

FOREIGN PATENT DOCUMENTS

| | | |
|---|---|---|
| JP | H1195553 A | 4/1999 |
| JP | 2003-255682 | 9/2003 |
| JP | 2007-163592 | 6/2007 |
| JP | 2007-310191 | 11/2007 |
| JP | 2008-262185 | 10/2008 |
| JP | 2010-019897 | 1/2010 |

OTHER PUBLICATIONS

Machine translation of JP 2003-255682 A , publication date: Sep. 10, 2003.*

* cited by examiner

*Primary Examiner* — Walter L Lindsay, Jr.
*Assistant Examiner* — Frederick Wenderoth
(74) *Attorney, Agent, or Firm* — Lucas & Mercanti, LLP

(57) ABSTRACT

In an image forming apparatus including an image carrier, a developing device which uses a developer including a toner and a carrier and to develop the electrostatic latent image and forms a visible toner image, plural toner supplying devices each of which supplies the toner in which mass ratio of an additive against the toner is different, and a control section which controls a ratio of a toner supplying amount to be supplied from each of the plural toner supplying devices, under a condition that toner consumption per a single print is low, the control section is configured to increase the toner supplying ratio of the toner including a high ratio of the additive, and under a condition that the toner consumption per the single print is high, the control section is configured to decrease the toner supplying ratio of the toner including a high ratio of the additive.

18 Claims, 4 Drawing Sheets

IMAGE FORMING APPARATUS

CROSS REFERENCE TO RELATED APPLICATION

This application is based on Japanese Patent Application No. 2010-232299 filed on Oct. 15, 2010, with the Japanese Patent Office, the entire content of which is hereby incorporated by reference.

TECHNICAL FIELD

The present invention relates to image forming apparatuses, such as copying machines, printing machines, facsimile devices, and compound devices including functions of the above machines and devices, and in particular, to image forming apparatuses including a developing device which develops an electrostatic latent image formed on an image carrier.

BACKGROUND OF THE INVENTION

Image forming apparatuses, such as copying machines using well known electro-photographic methods, charge electricity on their image carrier and expose it to form an electrostatic latent image. The electrostatic latent image, formed on the image carrier, is changed to a toner image by the developing device, and said toner image is transferred onto a recording sheet by a transfer device. After that, said toner image is heated to be fixed by a fixing device, to become a permanent image on the recording sheet.

The developing device uses a dual-component developer, including toner and carrier, and develops the electrostatic latent image formed on the image carrier, and generates a visible image.

After the developing process has been completed on a developing area the dual-component developer, in which the toner has been consumed, is recovered. Subsequently, the recovered developer is mixed with supplied toner, and said mixed developer is agitated to be used again for further image development. The developer, which is used in the developing device exhibiting the above recovering structure, is required to maintain a specific toner density, electrification amount, and additives, respectively at predetermined values, to obtain stable toner images. The toner density is determined by the toner, consumed in the developing operation, and the distribution of replenished toner. The electrification amount is determined by the frictional electrification, generated when the carrier and the toner are mixed. The developing device adequately conducts the agitation of dual-component developer, formed of a toner and carrier, so that the distribution of toner density is effectively uniformized, and the electrification amount to be applied to the toner can be saturated, which results in a stabilization of the toner image.

When toner consumption for a single print is relatively small, the staying time of the toner in the developing device becomes longer. The additives tend to separate from or become buried in the surface of the toner, and the electrification amount increases due to the agitation, which results in deterioration of the image quality. Various technologies are well known to maintain the image quality.

In order to overcome the deterioration of image quality, when toner consumption for a single print is relatively small, there is a well known method in which the toner is consumed at an area which is out of an image forming area, so that the staying time of the toner in the developing device is reduced.

However, the toner is consumed needlessly, which adversely results in the price for a single print.

According to Unexamined Japanese Patent Application 2003-255,682, an external additive supplying section is prepared to supply external additives. When the toner supplying section supplies relatively small amounts of toner, an external additive supplying section is controlled to supply a large amount of external additive, so that fogged images or flying toner particles are effectively controlled.

According to Unexamined Japanese Patent Application 2007-310,191, a toner accommodating section and an additive accommodating section are prepared in the toner supplying section. When the accommodated toner is reduced, the additive is supplied greater from the additive accommodating section, so that filming of the photoconductive body is effectively prevented.

According to Unexamined Japanese Patent Application 2007-163,592, due to the long operation of the developing device, when the remaining toner is excessively deteriorated, toner particles, exhibiting the different diameters from that of initially supplied toner particles, are supplied to the developing device, so that the image quantity can be stabilized.

According to Unexamined Japanese Patent Application 2008-262,185, toner to be supplied, exhibiting different diameters, can be set. Based on the diameter of the toner particles to be supplied, exposure energy, which serves as an image forming condition, is controlled so that the image quantity can be stabilized.

According to Unexamined Japanese Patent Application 2010-19,897, two kinds of toners, exhibiting different developing power, are used. When an image having a large image area is to be outputted, because the toner in the developing device increases the developing power, a large amount of toner having low developing power is supplied. When an image having a small image area is to be outputted, a large amount of toner having high developing power is supplied, so that the variation of developing density can be controlled.

As detailed above, deterioration of developer in the developing device is problematic. Specifically, when the amount of toner consumption per single print is low, the toner particles, which did not transfer from the developer carrier to the image carrier, are recovered and reused, whereby the time of the toner in the developing device becomes longer. Accordingly, additives tend to separate from or are buried in the surface of the toner particle, which leaves much mom for improvement.

To apply additives onto the surface of toner particles is effective for flowing capability and transferring capability. However, when the developer is used, which includes toner particles from which the additives have been separated, or on the surface of which the additives have been buried, the additives cannot function normally, that is, the flowing capability and the transferring capability become deteriorated. Said deterioration of the flowing capability adversely affects regulation of the surface of the developer, formed like brushes, which results in the generation of a rough image. This becomes conspicuous by the reverse phenomenon, in which the brushes strongly touch the image carrier. Further, deterioration of the transferring capability also results in the generation of the rough image.

SUMMARY OF THE INVENTION

The present invention has been achieved to solve the above problems. An object of the present invention is to offer an image forming apparatus which can stably output high quality images.

To achieve the abovementioned object, an image forming apparatus reflecting one aspect of the present invention includes:

an image carrier which is configured to carry an electrostatic latent image;

a developing device, which is configured to use a developer including a toner and a carrier, and to develop the electrostatic latent image, and forms a visible toner image;

plural toner supplying devices each of which is configured to supply the toner in which mass ratio of an additive against the toner is different; and a control section which is configured to control a ratio of a toner supplying amount to be supplied from each of the plural toner supplying devices, wherein under a condition that toner consumption per a single print is low, the control section increases the toner supplying ratio of the toner including a high ratio of the additive, and under a condition that toner consumption per a single print is high, the control section decreases the toner supplying ratio of the toner including a high ratio of the additive.

BRIEF DESCRIPTIONS OF THE DRAWINGS

Embodiments will now be detailed, by way of example only, with reference to the accompanying drawings which are meant to be exemplary, not limiting, and wherein like embodiments are numbered alike in the several figures, in which.

DETAILED DESCRIPTIONS OF THE PREFERRED EMBODIMENT

Figure 1:
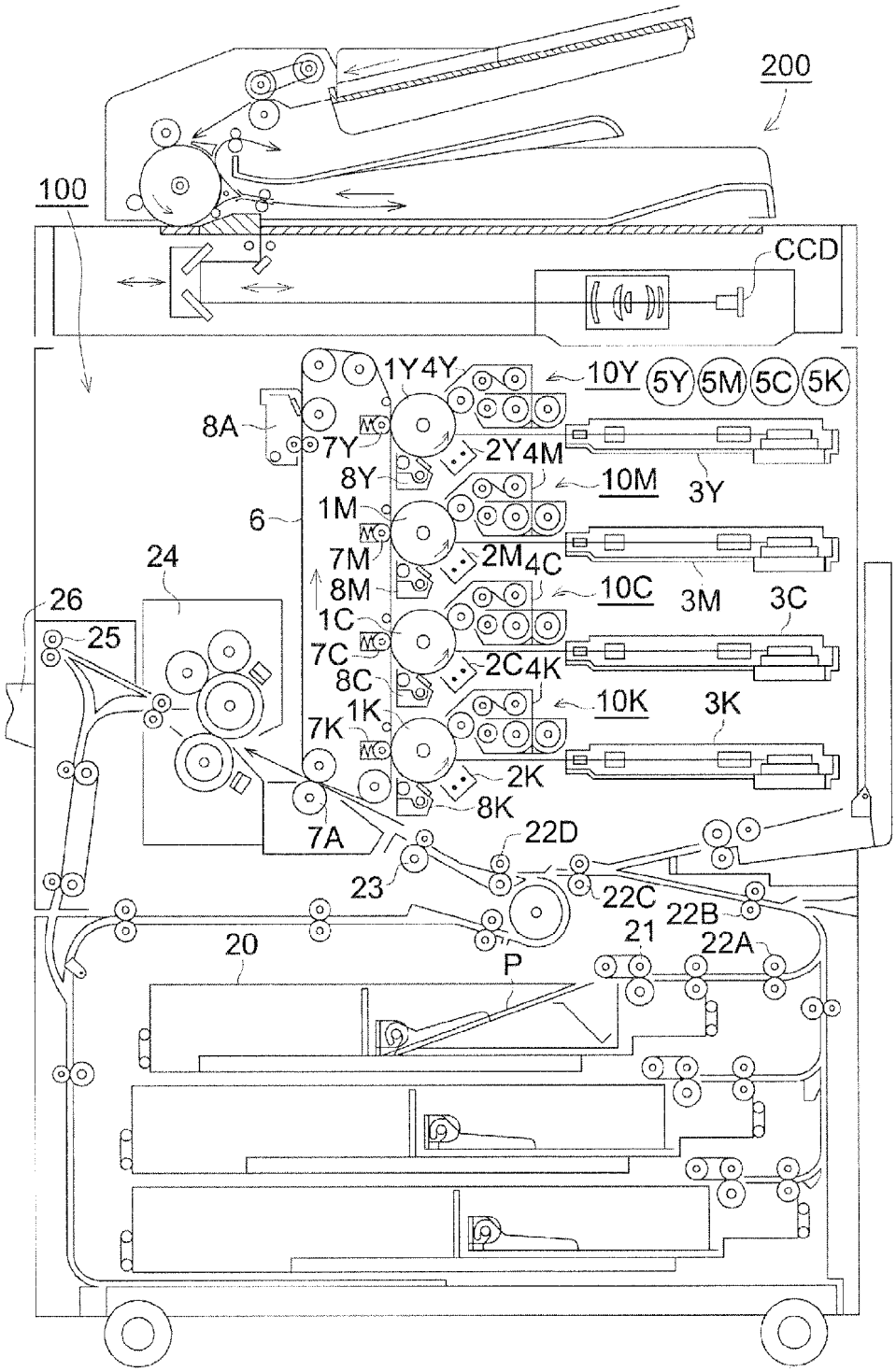
FIG. 1 shows the allover structure of a color copying machine.

The present invention will now be detailed, based on an embodiment shown in the drawings. The present invention is not limited to the embodiment.

As an example of an image forming apparatus incorporating plural developing devices, a structure of a color copying machine will now be detailed.

(Structure of Image Forming Apparatus)

FIG. 1 is the overall structure of a color copying machine which is structured of image forming apparatus 100 and image reading device 200.

Image forming apparatus 100, being a tandem-type full color image forming apparatus, includes plural image forming sections 10Y, 10M, 10C and 10K, intermediate transfer body 6, being an endless belt, sheet conveying sections, and fixing device 24.

Image forming section 10Y, which forms the yellow toner images, has charging section 2Y, exposure section 3Y, developing device 4Y, and cleaning section 8Y, all of which are arranged around image carrier 1Y.

Image forming section 10M, which forms the magenta toner images, has charging section 2M, exposure section 3M, developing device 4M, and cleaning section 8M, all of which are arranged around image carrier 1M.

Image forming section 10C, which forms the cyan toner images, has charging section 2C, exposure section 3C, developing device 4C, and cleaning section 8C, all of which are arranged around image carrier 1C.

Image forming section 10K, which forms the black toner images, has charging section 2K, exposure section 3K, developing device 4K, and cleaning section 8K, all of which are arranged around image carrier 1K.

Intermediate transfer body 6 is entrained about plural rollers, so that intermediate transfer body 6 is rotated.

Each of the color images, formed by image forming sections 10Y, 10M, 10C, and 10K, is sequentially transferred onto rotating intermediate transfer body 6 by transfer sections 7Y, 7M, 7C and 7K (which is the primary transfer operation) to be superposed, whereby a full color image is formed. Recording sheet P, accommodated in sheet supplying cassette 20, is supplied by sheet supplying section 21, and conveyed to transfer section 7A by sheet supplying rollers 22A, 22B, and 22C, and paired registration rollers 23, whereby, a full color image is transferred onto recording sheet P (which is a secondary transfer operation). Recording sheet P, carrying the full color image, is processed by fixing section 24, and ejected onto sheet ejection tray 26 by paired ejection rollers 25.

After recording sheet P receives the full color image from intermediate transfer body 6 by transfer section 7A, said recording sheet P is separated from intermediate transfer body 6. After that, intermediate transfer body 6 is cleaned by cleaning section 8A, so that the toner particles remaining on intermediate transfer body 6 are removed.

Toner supplying devices 5Y, 5M, 5C, and 5K supply new toner to developing devices 4Y, 4M, 4C, and 4K, respectively.

The above explanations concern the tandem-type color image forming apparatus which uses the intermediate transfer body relating to the present invention. The present invention can also be applied to a monochromatic image forming apparatus.

(Structure of the Developing Device)

Figure 2:
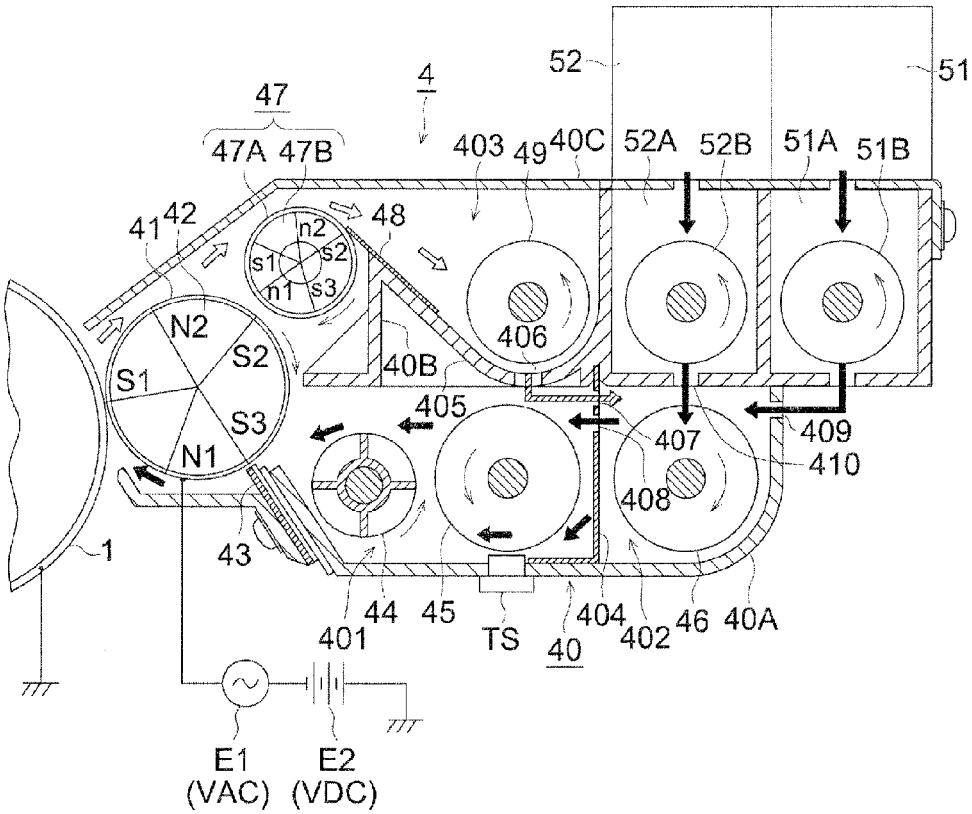
FIG. 2 is a cross sectional view of a developing device.
Figure 3:
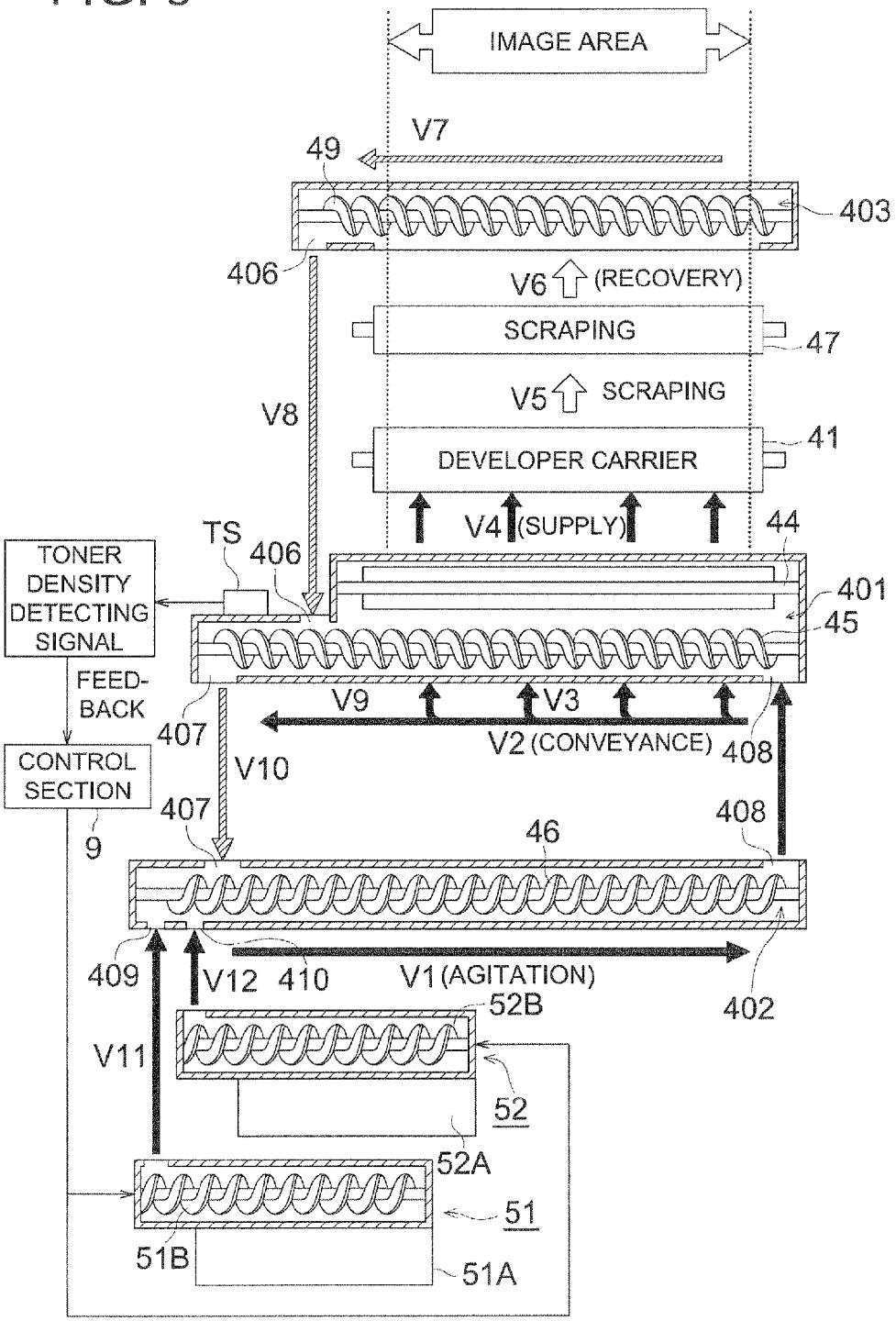
FIG. 3 shows circulation of the developer in the developing device.

FIG. 2 is a central cross-sectional drawing of the developing device. FIG. 3 is a schematic drawing to show the circulation of the developer in the developing device. Hereinafter, image carriers 1Y, 1M, 1C and 1K are referred to as image carrier 1, developing devices 4Y, 4M, 4C and 4K are referred to as developing device 4, and toner supplying devices 5Y, 5*m*, 5C and 5K are referred to as toner supplying device 5.

Developing device 4 is structured of developing device main body 40, developing sleeve 41, magnetic roller 42, developer regulating member (being an ear reaping plate) 43, supplying member (being a paddle wheel) 44, conveyance member (being a conveying screw) 45, agitating member (being an agitating screw) 46, scraping roller 47, soaping plate (being a scraper) 48, recovery member (being a toner recovering screw) 49, and toner density sensor TS.

Developing sleeve 41, arranged to face image carrier 1 to carry the electrostatic latent image, is supported and rotatable, whereby developing sleeve 41 is configured to make the toner image to be visible on image carrier 1. Alternating voltage and direct current voltage are superimposed on developing sleeve 41, as a developing bias. Developing sleeve 41 functions as the developer carrier of the present invention.

Magnet roller 42, arranged within developing sleeve 41, has plural magnetic poles N1, N2, S1, S2, and S3. Among said plural poles of magnet roller 42, two magnetic poles S2 and S3, being adjacent to one another, are arranged to be the same polarity, so that they repel one another. Magnetic pole S2 scrapes the developer on developing sleeve 41 off Magnetic pole S3, which functions to receive the developer, attracts the developer supplied from supplying member 44, and makes the attracted developer to adhere onto developing sleeve 41.

Supplying member 44 is a rotatable paddle to supply the developer to developing sleeve 41. Supplying member 44 evenly supplies the developer, conveyed from conveying member 45, in the vicinity of magnetic pole S3 functioning to receive the developer.

Conveyance member 45, arranged to be parallel to supplying member 44, agitates the developer conveyed from agitating member 46, and conveys said developer to supplying member 44.

Agitating member 46 mixes and agitates the new toner, supplied from first toner supplying device 51 or second toner supplying device 52, with the developer flown back from conveyance member 45, and conveys it to an upstream portion of conveyance member 45.

Scraping roller 47 is arranged in the vicinity of magnetic pole S2 functioning to scrape off any developer on developing sleeve 41. Soaping roller 47 is structured of rotating member (being a sleeve) 47A, and cylindrical magnetic body 47B, mounted on developing device main body 40, wherein said body 47B is accommodated within rotating member 47A. Magnetic body 47B is formed of five magnetic poles n1, n2, s1, s2, and s3, for example. Magnetic pole n1 faces magnetic pole S2 for scraping off the developer of developing sleeve 41, and two magnetic poles s2 and s3, being adjacent to one another, are the same polarity to form the repelling magnetic field.

The top of scraping plate 48 stands close to or is in contact with magnetic pole s2. Scraping plate 48 and scraping roller 47 form a scraping section. By magnetic pole S2 for scraping the developer on developing sleeve 41, the developer flies from the surface of developing sleeve 41, subsequently said developer is attracted by magnetic pole n1 in scraping roller 47. Then, said developer is carried and conveyed by rotating member 47A. In the vicinity of magnetic pole s2, said developer is scraped off by scraping plate 48, and falls in recovering section 403.

Toner recovery member 49, arranged to be rotated within developer recovery section 403, recovers the falling developer, scraped by scraping roller 47 and scraping plate 48, and conveys it beyond the developing area of developing sleeve 41, which exists downstream in the conveying direction of conveying member 45. Within a position from which the recovered developer does not return to developing sleeve 41, the recovered developer can be conveyed within the developing area of developing sleeve 41, which exists downstream in the conveying direction of conveying member 45. Other than that, the developer recovered by recovering member 49 can be flown back upstream of developer agitating section 402.

Conveying member 45, agitating member 46, and recovering member 49, each of which is a spiral screw, convey the developer in their rotating directions, so that said members convey the developer parallel to their rotating shafts.

Developing device main body is structured of lower body 40A to support supplying member 44, conveying member 45, and agitating member 46, central body 40B to support recovering member 49, and top cover 40C to close the upper opening section of central body 40B.

Lower body 40A is structured of developer supplying section 401 to accommodate supplying member 44 and conveying member 45, and developer agitating section 402 to accommodate agitating member 46. Developer supplying section 401 and developer agitating section 402 are formed to sandwich first partition wall 404 standing on the bottom of lower body 40A.

Second partition wall 405, formed on the bottom of central body 40B rotatably supporting recovering member 49, divides developer supplying section 401 and developer recovering section 403. Further, a portion of central body 40B closes the upper opening section of developer agitating section 402.

The downstream side of developer recovering section 403 in the developer conveying direction, and the downstream side of developer supplying section 401 in the developer conveying direction, are connected to each other, through first opening section 406, formed adjacent to the end of second partition wall 405.

The downstream side of developer supplying section 401 in the developer conveying direction, and the upstream side of developer agitating section 402 in the developer conveying direction, are connected to each other, through second opening section 407, formed adjacent to the end of first partition wall 404.

The downstream side of developer agitating section 402 in the developer conveying direction, and the upstream side of developer supplying section 401 in the developer conveying direction, are connected to each other, through third opening section 408, formed adjacent to the other end of first partition wall 404.

Toner density sensor TS, mounted on the bottom of developer supplying section 401, being downstream in the conveying direction of the developer, is configured to detect the toner density of the developer to be conveyed. Based on the detected toner density signal, control section 9 activates first toner supplying device 51, or second toner supplying device 52, to supply new toner to first toner supply opening section 409, and second toner supply opening section 410, wherein both opening sections 409 and 410 are mounted at the upstream side of developer agitating section 402 in the conveying direction of the developer. Control section 9 can conduct the toner supplying control from first toner supplying device 51 and second toner supplying device 52, based on an image density optically detected from the image after the development.

The developer, scraped off by scraping roller 47 and scraping plate 48, is recovered in developer recovering section 403. After said developer is conveyed downstream by recovering member 49, in the direction of the developer conveyance, said developer is flown back into developer supplying section 401, through first opening section 406 which penetrates second partition wall 405.

The developer in developer supplying section 401 is further conveyed by conveying member 45 to developer agitating section 402, through second opening section 407 which penetrates the end of first partition wall 404. Said developer, conveyed to developer agitating section 402, is mixed with the toners, supplied by first toner supply opening section 409 and second toner supply opening section 410, and agitated before being conveyed. Mixed developer is then ejected through third opening section 408 which penetrates the other end of first partition wall 404, and the mixed developer is flown back to developer supplying section 401. In developer supplying section 401, the mixed developer is conveyed in the axial direction by supplying member 44, and is supplied to developing sleeve 41.

It is preferable that first opening section 406, second opening section 407, and third opening section 408 are arranged at a non-image forming area of developing sleeve 41, wherein said first opening section 406 is arranged on the end of second partitioning wall 405 between developer recovering section 403 and developer supplying section 401, and wherein said second opening section 407 and said third opening section 408 are arranged on both ends of first partitioning wall 404 between developer supplying section 401 and developer agitating section 402.

Since the rotating direction of both supplying member 44 and conveying member 45 is formed to be the same as that of developing sleeve 41, it is possible to effectively and stably supply the developer to developing sleeve 41, resulting in good images.

Further, since the rotating direction of recovering member 49 is formed to be opposite that of developing sleeve 41, it is possible to reduce the reverse flow of the developer in developer recovering section 403. Still further, the developer conveying force of supplying member 44 is set to be smaller than that of conveying member 45. Due to these factors, the developer is prevented from adversely packing downstream of supplying member 44 in the developer conveying direction, so that the developer can be supplied to developing sleeve 41, while the durability of the developer is not reduced.

(Toner Supplying Device)

First toner supplying device 51 is formed of toner container 51A to accommodate the toner, and conveying member 51B having a rotating body to agitate and convey the toner. Conveying member 51B is a spiral screw having a rotating shaft and a spiral section, which conveys the toner in the direction parallel to the rotating shaft, to toner supply opening section 409.

Second toner supplying device 52, structured to be the same as first toner supplying device 51, agitates the accommodated toner, and conveys it to toner supply opening section 410.

First toner supplying device 51 and second toner supplying device 52 accommodate toner, the additives of which are different from each other. The toner supplying ratios of said devices 51 and 52 are controlled by control section 9, based on the toner consumption amount for every single print, which will be detailed later.

(Circulating Conveyance of the Developer)

Circulation of the developer will be detailed while referring to FIG. 3.

(1) At an upstream portion of developer agitating section 402, the new toners and the developers, sent back from developer supplying section 401 and developer recovering section 403, are mixed, and conveyed in the direction shown by arrow V1.

(2) Said mixed and agitated developer is conveyed to an upstream portion of developer supplying section 401 through third opening section 408. In developer supplying section 401, while said developer is conveyed in the direction shown by arrow V2, said developer is conveyed to supplying member 44, in the directions shown by arrows V3.

(3) Supplying member 44 does not convey the developer in its axial direction, but conveys the developer to developing sleeve 41 in the directions shown by arrows V4.

(4) The developer on developing sleeve 41 is developed on the developing area facing image carrier 1. After development, the toner density of the developer becomes low. Said developer is scraped off from developing sleeve 41 by scraping roller 47 of the scraping section as shown by arrow V5, and is conveyed on scraping roller 47.

(5) The developer on scraping roller 47 is scr ped by scraping plate 48, and stored in developer recovering section 403, as shown by arrow V6.

(6) Said recovered developer stored in developer recovering section 403 is conveyed by rotating recovering member 49 in the direction of arrow V7.

(7) Subsequently, said recovered developer is ejected from first opening section 406, located at a downstream portion of developer recovering section 403, and conveyed away from the imaging area, which is downstream of developer supplying section 401, as shown by arrow V8.

(8) The above described developer, supplied to first opening section 406 of developer supplying section 401, is conveyed in the direction shown by arrow V9, whose toner density is checked by toner density sensor TS. Subsequently, said developer is conveyed in the direction shown by arrow V10 to an upstream portion of developer agitating section 402 through second opening section 407.

(9) In developer agitating section 402, based on the toner density signal sent from toner density sensor TS, control section 9 activates first toner supplying device 51 and second toner supplying device 52, to supply the toner from first toner supply opening section 409 and second toner supply opening section 410 respectively, as shown by arrows V11 and V12. That is, the developer interflows with arrow V1, in which the circulation of the developer is completed.

(Control of Supplying Ratio of the Toner)

First toner supplying device 51 and second toner supplying device 52 accommodate the toner, the additives of which are different from each other.

Concerning the additives on the surface of the toner particles in the developer sent back from developer recovering section 403, the additives are more separated from the surfaces of the toner particles, or more buried in the same surfaces, than the additives of newly supplied toner, which is due to repeated agitations of the used toners. Accordingly, the flowing capability and the transferring capability of the additives of the developer are deteriorated. Specifically, when the toner consumption for a single print is less, the toner amount (being toner density) in the recovered developer becomes great. Accordingly, concerning the toner stored in developer agitating section 402, the ratio of toner, exhibiting reduced flowing capability and transferring capability, becomes greater.

Referring to the toner density signal sent from toner density sensor TS, control section 9 controls the toner supplying ratios from first toner supplying device 51 and second toner supplying device 52, based on the toner consumption for a single print, so that the function of the additive is prevented from being deteriorated.

The toner consumption is determined by the printing ratio of a printed image per unit length in the circumferential direction of image carrier 1.

Figure 4:
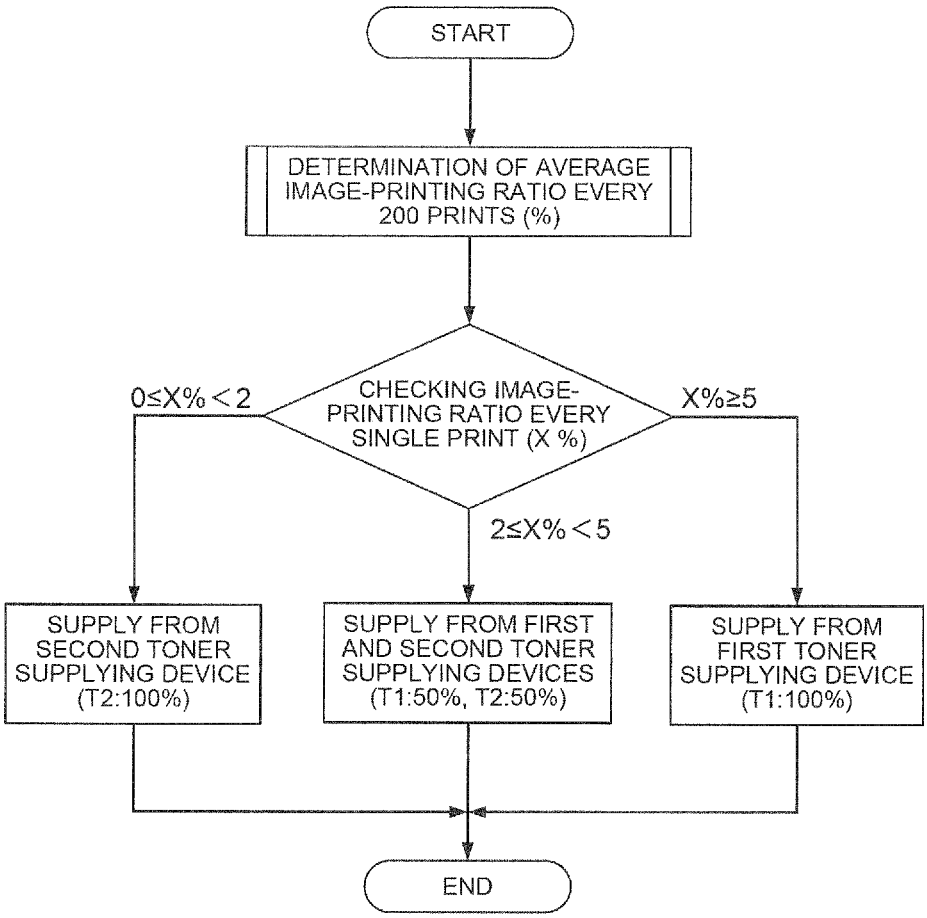
FIG. 4 is a flow chart to show control of the supplying ratio of the toners.

FIG. 4 is a flow chart to show control concerning the supplying ratio of the toner.

When the average printing ratio every 200 prints is less than 2%, second toner supplying device 52 supplies the toner, while first toner supplying device 51 does not supply the toner.

When the average printing ratio every 200 prints is equal to or greater than 2% but less than 5%, second toner supplying device 52 and first toner supplying device 51 supply 50% of the toner individually.

When the average printing ratio every 200 prints is equal to or greater than 5%, first toner supplying device 51 supplies the toner, while second toner supplying device 51 does not supply the toner.

Further, the toner consumption amount is determined by not only the printing ratio of the printed image, but also rotating frequencies of conveying member 51B of first toner supplying device 51 and conveying member 52B of second toner supplying device 52 every predetermined number of prints, toner supplying time, or total supplied amounts of toner.

Embodiments of the present invention will now be detailed, but the present invention is not limited to these embodiments.

In an environment marked by temperature of 25° C. and humidity of 50%, the toner supplying ratio of first and second toner supplying devices 51 and 52 are varied, depending on the image printing area ratio. Under each setting condition, 2,000 sheets of "A4" size sheets are used for assurance tests.

Table 1 shows specifications of an image forming apparatus used for said assurance tests.

TABLE 1

| | |
|---|---|
| DIAMETER OF IMAGE CARRIER (PHOTOSENSITIVE DRUM) | 60 mm |
| DIAMETER OF DEVELOPING SLEEVE (DEVELOPING ROLLER) | 25 mm |
| SURFACE SPEED OF DEVELOPING SLEEVE (DEVELOPING ROLLER) | 720 mm/sec (REVERSAL DEVELOPMENT) |
| CLEARANCE BETWEEN DEVELOPING SLEEVE AND IMAGE CARRIER | 0.30 mm |
| DEVELOPER CONVEYING AMOUNT ON DEVELOPING SLEEVE | 220 g/m$^2$ |
| IMAGE FORMING APPARATUS | MONOCHROMATIC APPARATUS OUTPUTTING 80 PPM (PROCESS SPEED 400 mm/sec) |
| DIAMETER OF TONER PARTICLE | 6.5 μm |
| DIAMETER OF CARRIER PARTICLE | 33 μm |
| TONER DENSITY (BEING MASS RATIO OF TONER AND CARRIER) | 7 MASS % |
| DEVELOPER AMOUNT IN DEVELOPING DEVICE | 1,000 g |

In the assurance test, a comparative assurance apparatus is used, in which additives are supplied to a developer agitating section, depending on the toner supplying amounts described in paragraphs 0076-0084 of Unexamined Japanese Patent Application 2003-255,682. The assurance test of comparative examples was conducted to supply the additive, depending on the additive supplying amount (shown in Table 2), in which the additive is calculated by the toner supplying amount for every image printing ratio of the image to be printed.

The amount of the additive to be supplied is set to 2 mass percent of normal use.

TABLE 2

| IMAGE PRINTING RATIO FOR EVERY SINGLE PRINT (%) | SUPPLIED AMOUNT OF TONER (g/200 PRINTS) | SUPPLYING AMOUNT OF ADDITIVE (g/200 PRINTS) |
|---|---|---|
| 0 | 0.00 | 0.84 |
| 1 | 0.62 | 0.83 |
| 2 | 1.23 | 0.83 |
| 3 | 1.85 | 0.82 |
| 4 | 2.47 | 0.81 |
| 5 | 3.09 | 0.80 |

(Embodiment 1)

Two sets of toner supplying devices are used, which accommodate the supplying toner including toners and additives, wherein the toners and the additives exhibit different mass from each other. Depending on the image printing ratio of the printed image, the supplying ratio from both toner supplying devices are controlled.

First toner supplying device 51 accommodates the toner of 2 mass %, including a normal amount of the additive, while second toner supplying device 52 accommodates the toner of 6 mass %, including an increased amount of the additive.

"T1" represents the toner supplied from first toner supplying device 51, while "T2" represents the toner supplied from second toner supplying device 52.

The image printing ratio of the printed image and the supplying ratio of toner are shown in Table 3.

TABLE 3

| IMAGE PRINTING RATIO (%) | RATIO OF SUPPLIED TONER |
|---|---|
| 0 ≤ IMAGE PRINTING RATIO ≤ 2 Note 1 | T1: 0%, T2: 100% |
| 2 < IMAGE PRINTING RATIO < 5 | T1: 50%, T2: 50% |
| 5 ≤ IMAGE PRINTING RATIO | T1: 100%, T2: 0% |

Note 1:
When the image printing ratio is 0%, toner corresponding to image printing ratio of 0.5% is consumed at an area which is out of the image forming area.

(Embodiment 2)

Two sets of toner supplying devices accommodating plural supplying toners are used. Concerning each of said plural supplying toners, the component ratio of the additives, having different diameters, are different from each other.

Depending on the image printing ratio of the printed image, the supplying ratio from both toner supplying devices are controlled.

First toner supplying device 51 accommodates the toner having the additive exhibiting a large diameter, approximately 50 nm and 0.75 mass %, and the toner having the additive exhibiting a small diameter, approximately 15 nm and 0.75 mass %. Second toner supplying device 52 accommodates the toner having the additive exhibiting a large diameter, approximately 50 nm and 1.0 mass %, being an increase of mass %, and the toner having the additive exhibiting a small diameter, approximately 15 nm and 0.5 mass %, being a decrease of mass %.

"T1" represents the toner supplied from first toner supplying device 51, while "T2" represents the toner supplied from second toner supplying device 52.

The image printing ratio of the printed image and the supplying ratio of toner are shown in Table 4.

TABLE 4

| IMAGE PRINTING RATIO (%) | RATIO OF SUPPLYING TONER |
|---|---|
| 0 ≤ IMAGE PRINTING RATIO ≤ 2 Note 1 | T1: 0%, T2: 100% |
| 2 < IMAGE PRINTING RATIO < 5 | T1: 50%, T2: 50% |
| 5 ≤ IMAGE PRINTING RATIO | T1: 100%, T2: 0% |

Note 1:
When the image printing ratio is 0%, toner corresponding to an image printing ratio of 0.5% is consumed at an area which is out of the image forming area.

(Embodiment 3)

A toner supplying device is used, in which plural types of additives and specific additives are included, and another toner supplying device is also used, hi which plural types of additives are included, but no specific additive is included. Depending on the image printing ratio of the printed image, the supplying ratio from both toner supplying devices are controlled.

First toner supplying device 51 accommodates the toner having the additive exhibiting a large diameter, approximately 50 nm and 035 mass %, and the toner having the additive exhibiting a small diameter, approximately 15 nm and 0.75 mass %. Second toner supplying device 52 accommodates the toner having the additive exhibiting a large diameter, approximately 50 nm and 0.75 mass %, and the toner having the additive exhibiting a large diameter, approximately 80 nm and 0.2 mass %, and the toner having the additive exhibiting a small diameter, approximately 15 nm and 0.75 mass %.

In Embodiment 3, the additive exhibiting a large diameter, approximately 80 nm, is used as a specific additive, in which the toner, including the additive of 80 nm diameter and the toner, not including the same, are used. However, the specific additives can be determined as the additives exhibiting the different diameters, as well as the additives formed of different materials.

"T1" represents the toner supplied from first toner supplying device 51, while "T2" represents the toner supplied from second toner supplying device 52.

The image printing ratio of the printed image and the supplying ratio of toner are shown in Table 4.

TABLE 5

| IMAGE PRINTING RATIO (%) | RATIO OF SUPPLIED TONER |
|---|---|
| 0 ≤ IMAGE PRINTING RATIO ≤ 2 Note 1 | T1: 0%, T2: 100% |
| 2 < IMAGE PRINTING RATIO < 5 | T1: 50%, T2: 50% |
| 5 ≤ IMAGE PRINTING RATIO | T1: 100%, T2: 0% |

Note 1:

When the image printing ratio is 0%, toner corresponding to image printing ratio of 0.5% is consumed at an area which is out of the image forming area.

Outcome evaluation of the image quality in Embodiments 1-3 will now be detailed.

Tables 6 and 8 show the results for Embodiment 1. In Table 6, after continuous printing of 2,000 pages of "A4" size sheets with individual image printing ratio, image granularity (being image roughness) in the printed sheet is checked. No roughness observed by a visual check is shown by "A", allowable roughness is shown by "B", and not-allowable roughness is shown by "C". In Table 7, after continuous printing of 2,000 pages of "A4" size sheets, five sheets of solid printing (being image printing ratio of 100%) are outputted. The total number of white round marks, being cores of aggregated additives, is counted as poor transfer portions.

TABLE 6

| IMAGE PRINTING RATIO (%) | EMBODIMENT 1 | COMPARATIVE EXAMPLE |
|---|---|---|
| 0 | A | B |
| 1 | A | B |
| 2 | A | A |
| 3 | A | A |
| 4 | A | A |
| 5 | A | A |

TABLE 7

| IMAGE PRINTING RATIO (%) | EMBODIMENT 1 | COMPARATIVE EXAMPLE |
|---|---|---|
| 0 | 0 | 3 |
| 1 | 0 | 3 |
| 2 | 0 | 2 |
| 3 | 0 | 1 |
| 4 | 0 | 1 |
| 5 | 0 | 1 |

Table 8 shows the results for Embodiment 2, in which image roughness is checked in the same way as for Embodiment 1.

TABLE 8

| IMAGE PRINTING RATIO (%) | EMBODIMENT 1 | COMPARATIVE EXAMPLE |
|---|---|---|
| 0 | A | B |
| 1 | A | B |
| 2 | A | A |
| 3 | A | A |
| 4 | A | A |
| 5 | A | A |

Table 9 shows the results for Embodiment 3, in which the image roughness is checked in the same way as Embodiment 1.

TABLE 9

| IMAGE PRINTING RATIO (%) | EMBODIMENT 1 | COMPARATIVE EXAMPLE |
|---|---|---|
| 0 | A | B |
| 1 | A | B |
| 2 | A | A |
| 3 | A | A |
| 4 | A | A |
| 5 | A | A |

After repeated agitation and recovery of the toner in the developing device, the surface condition of the toner in the developing device differs to that of newly supplied toner. When the toner in the developing device is mixed with newly supplied toner, the additives on the newly supplied toner tend to shift to the surfaces of the toner particles in the developing device, whereby the amount of additives on the toner in the developing device increases. By electronic microscopic observation, it is understood that the additives on the newly supplied toner have shifted to the surfaces of the toner particles in the developing device.

Poor transfer and image roughness are prevented by the above shifting phenomena, which were due to the separation and burying of additives.

According to the present invention, when the image printing ratio is low, the supplied toner carrying more additives are increased, or the type of the additives is changed, so that the problems due to poor transfer and increased roughness are effectively solved.

In the same way as in above, when the image printing ratio is low, the amount of toner to be ejected onto the non-imaging area can be effectively decreased.

According to the present embodiments, plural devices for supplying toner are provided, in which various mass ratios of the additive to the toner are prepared. When toner consumption per single print is relatively low, much toner, having a large ratio of the additives, is supplied. When toner consumption per single print is relatively high, less toner, having a large ratio of the additives, is supplied. Accordingly, in the developing device, stably controlled is function of the additive, adhered to the surface of the toner particles, so that high quality images can be stably outputted.

What is claimed is:

1. An image forming apparatus comprising:

an image carrier which is configured to carry an electrostatic latent image;

a developing device, which is configured to use a developer including a toner and a carrier, and to develop the electrostatic latent image, and forms a visible toner image;

plural toner supplying devices, each of which is configured to supply the toner in which mass ratio of an additive against the toner is different; and a control section which is configured to control a ratio of a toner supplying amount to be supplied from each of the plural toner supplying devices, wherein under a condition that toner consumption per a single print is low, the control section is configured to increase the toner supplying ratio of the toner including a high ratio of the additive, and under a condition that the toner consumption per the single print is high, the control section is configured to decrease the toner supplying ratio of the toner including a high ratio of the additive.

2. The image forming apparatus of claim 1, wherein the control section is configured to control the toner consumption per a single print, based on an image printing ratio formed by an image forming section.

3. The image forming apparatus of claim 1, wherein the control section is configured to control the toner consumption per a single print, based on a total of the toner supplying amount of each of the plural toner supplying devices.

4. The image forming apparatus of claim 1, wherein the plural toner supplying devices are configured to supply the toner including plural types of the additives, wherein component ratios of the additives against the toner in the plural toner supplying devices are different from each other.

5. The image forming apparatus of claim 4, wherein diameters of the plural types of the additives are different from each other.

6. The image forming apparatus of claim 5, wherein under the condition that the toner consumption per a single print is low, the toner supplying ratio of the toner including a higher ratio of the additive exhibiting a large diameter is increased, and under the condition that the toner consumption per a single print is high, the toner supplying ratio of the toner including a higher ratio of the additive exhibiting a small diameter is increased.

7. The image forming apparatus of claim 1, wherein the plural toner supplying devices are configured to supply the toner including the plural types of the additives, so that the types of the toner supplied from the plural toner supplying devices are different with each other.

8. The image forming apparatus of claim 7, wherein the plural toner supplying devices are configured to include a toner supplying device which supplies the toner including a specific additive, and a toner supplying device which supplies the toner not including the specific additive.

9. The image forming apparatus of claim 8, wherein under the condition that the toner consumption per a single print is low, the toner supplying ratio of the toner including the specific additive is increased, and under the condition that the toner consumption per a single print is high, the toner supplying ratio of the toner not including the specific additive is increased.

10. A method of supplying a toner in an image forming apparatus which includes:

an image carrier which is configured to carry an electrostatic latent image;

a developing device, which is configured to use a developer including a toner and a carrier, and to develop the electrostatic latent image, and forms a visible toner image;

plural toner supplying devices, each of which is configured to supply the toner in which mass ratio of an additive against the toner is different; and a control section which is configured to control a ratio of a toner supplying amount to be supplied from each of the plural toner supplying devices, comprising the steps of:

under a condition that toner consumption per a single print is low, increasing the toner supplying ratio of the toner including a high ratio of the additive, and under a condition that the toner consumption per the single print is high, decreasing the toner supplying ratio of the toner including a high ratio of the additive.

11. The method of claim 10, further comprising the step of controlling the toner consumption per a single print, based on an image printing ratio formed by an image forming section.

12. The method of claim 10, further comprising the step of controlling the toner consumption per a single print, based on a total of the toner supplying amount of each of the plural toner supplying devices.

13. The method of claim 10, further comprising the step of supplying the toner including plural types of the additives, wherein component ratios of the additives against the toner in the plural toner supplying devices are different from each other.

14. The method of claim 13, wherein diameters of the plural types of the additives are different from each other.

15. The method of claim 14, further comprising the steps of under the condition that the toner consumption per a single print is low, increasing the toner supplying ratio of the toner including a higher ratio of the additive exhibiting a large diameter, and under the condition that the toner consumption per a single print is high, increasing the toner supplying ratio of the toner including a higher ratio of the additive exhibiting a small diameter.

16. The method of claim 10, further comprising the step of supplying the toner including the plural types of the additives, so that the types of the toner supplied from the plural toner supplying devices are different with each other.

17. The method of claim 16, wherein the plural toner supplying devices are configured to include a toner supplying device which supplies the toner including a specific additive, and a toner supplying device which supplies the toner not including the specific additive.

18. The method of claim 17, further comprising the steps of:

under the condition that the toner consumption per a single print is low, increasing the toner supplying ratio of the toner including the specific additive, and under the condition that the toner consumption per a single print is high, increasing the toner supplying ratio of the toner not including the specific additive.

* * * * *